US006817636B1

(12) United States Patent
Evans et al.

(10) Patent No.: US 6,817,636 B1
(45) Date of Patent: Nov. 16, 2004

(54) LATCH ASSEMBLY

(75) Inventors: Michael Evans, Chapel (GB); James Frost, Stourbridge (GB); Nigel Spurr, Solihull (GB)

(73) Assignee: Meritor Light Vehicle Systems (UK) Limited (GB)

( * ) Notice: Subject to any disclaimer, the term of this patent is extended or adjusted under 35 U.S.C. 154(b) by 19 days.

(21) Appl. No.: 10/030,024

(22) PCT Filed: Jun. 30, 2000

(86) PCT No.: PCT/GB00/02540

§ 371 (c)(1),
(2), (4) Date: Oct. 11, 2002

(87) PCT Pub. No.: WO01/02677

PCT Pub. Date: Jan. 11, 2001

(30) Foreign Application Priority Data

Jul. 1, 1991 (GB) ..... 99154320

(51) Int. Cl.[7] ..... E05C 3/06
(52) U.S. Cl. ..... 292/201; 292/216
(58) Field of Search ..... 292/201, 216

(56) References Cited

U.S. PATENT DOCUMENTS

| | | | | | |
|---|---|---|---|---|---|
| 3,664,698 | A | * | 5/1972 | Stropkay | 292/201 |
| 4,203,621 | A | * | 5/1980 | Noel et al. | 292/216 |
| 4,664,430 | A | * | 5/1987 | Bernard | 292/201 |
| 4,667,990 | A | * | 5/1987 | Quantz | 292/201 |
| 4,763,936 | A | * | 8/1988 | Rogakos et al. | 292/201 |
| 4,783,102 | A | * | 11/1988 | Bernard | 292/216 |
| 4,815,775 | A | * | 3/1989 | Mertin et al. | 292/201 |
| 4,948,184 | A | | 8/1990 | Weyerstall et al. | |
| 4,978,153 | A | * | 12/1990 | Hirsch et al. | 292/201 |
| 5,137,311 | A | | 8/1992 | Brackmann | |
| 5,173,311 | A | * | 12/1992 | Rensen | 425/99 |
| 5,697,237 | A | * | 12/1997 | Dilger et al. | 70/264 |
| 5,868,444 | A | * | 2/1999 | Brackmann et al. | 292/201 |
| 5,934,717 | A | * | 8/1999 | Wirths et al. | 292/201 |
| 5,938,253 | A | * | 8/1999 | Szablewski et al. | 292/216 |
| 5,944,367 | A | * | 8/1999 | Imaizumi et al. | 292/201 |
| 6,000,257 | A | * | 12/1999 | Thomas | 70/279.1 |
| 6,050,117 | A | * | 4/2000 | Weyerstall | 70/277 |
| 6,148,651 | A | * | 11/2000 | Roncin | 70/264 |
| 6,155,124 | A | * | 12/2000 | Wirths | 74/89.13 |

FOREIGN PATENT DOCUMENTS

| | | | |
|---|---|---|---|
| DE | 3220705 | A1 | 12/1983 |
| DE | 196 14 123 | A1 | 10/1997 |
| GB | 918165 | * | 2/1963 |
| GB | 2 155 535 | A | 9/1985 |
| GB | 2 162 234 | A | 1/1986 |
| WO | WO95/09289 | | 4/1995 |
| WO | WO01/02677 | A3 | 1/2001 |
| WO | WO01/02677 | A2 | 1/2001 |

OTHER PUBLICATIONS

Patents Act 1977 Search Report under Section 17 dated Oct. 27, 1999.

PCT Written Opinion mailed May 21, 2001.

* cited by examiner

*Primary Examiner*—Daniel P. Stodola
*Assistant Examiner*—Carlos Lugo
(74) *Attorney, Agent, or Firm*—Carlson, Gaskey & Olds

(57) ABSTRACT

A latch mechanism includes a power actuator that does not require back driving of the drive train. The latch mechanism includes a latch bolt movable between a primary latched position and an open position. A first pawl secures and releases the latch bolt by moving between a latched position and released position. A release device moves between an engaged position, which allows the first pawl to reach an engaged position, and a released position, which retains the first pawl in its released position. A second pawl moves between an engaged position, which retains the release device in its released position, and a released position, which releases the release device.

29 Claims, 4 Drawing Sheets

Fig-4
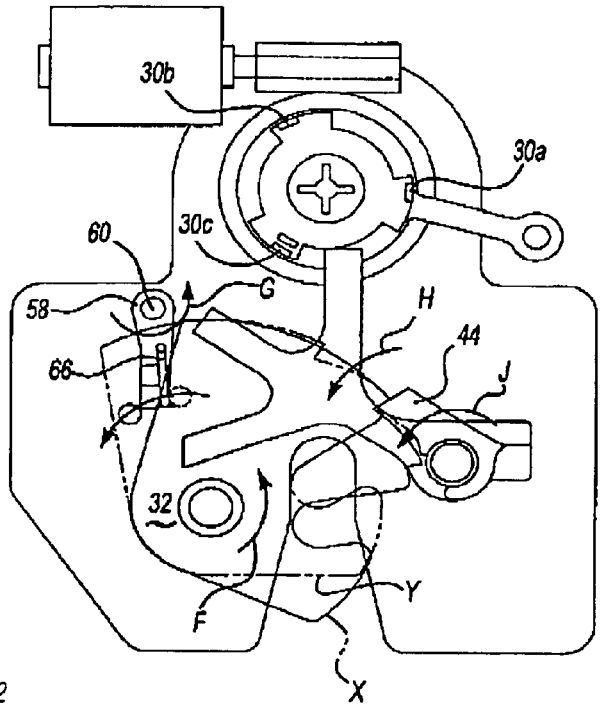
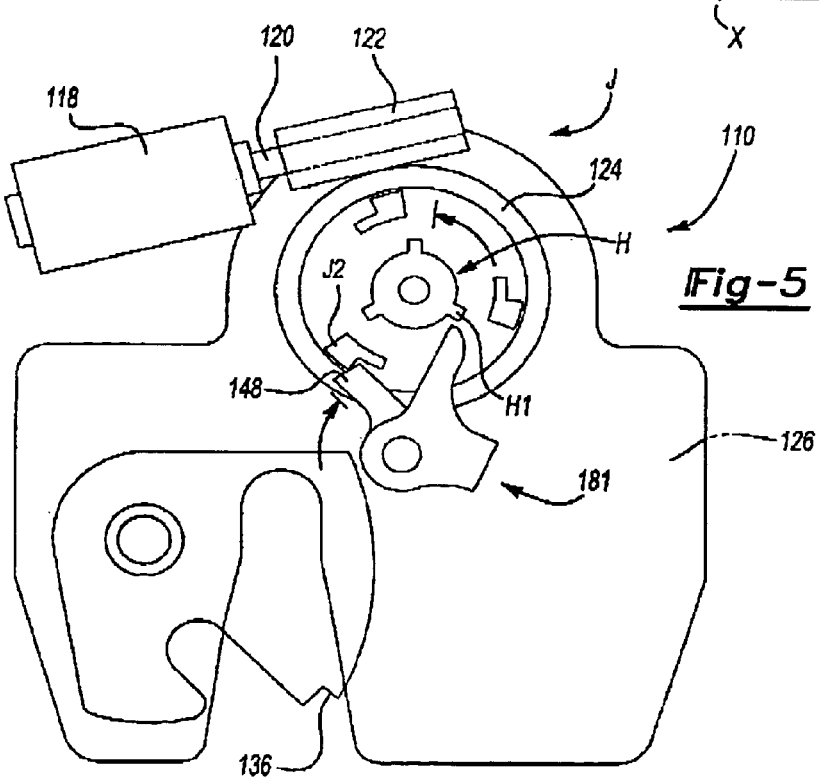
Fig-5

LATCH ASSEMBLY

This patent application claims priority to Great Britain Patent Application No. GB 9915432.0 filed on Jul. 1, 1999 and PCT Application PCT/GB00/02540, filed on Jun. 30, 2000.

BACKGROUND OF THE INVENTION

The present invention relates to latch assemblies, and in particular latch assemblies which are manually operable alone or latch assemblies which are both manually operable and power actuator operable.

The present invention is particularly applicable to latches used on vehicle doors such as car passenger doors or car trunk doors.

Vehicle door latches are known which are released using a power actuator. Typically the door latch would have a latch bolt retained in position by a pawl and the actuator would act on a release lever connected to the pawl or would act directly on the pawl to release the latch. After the actuator's power stroke, the actuator must return to its initial state in one of three traditional methods:

a) Reverse energizing of the motor such that the motor is spun in its opposite direction e.g., reversing the polarity on an electric motor, b) Declutching a clutch mechanism situated between the motor and a drive train of the actuating mechanism and returning the drive train by a weak spring, c) Back driving the whole of the actuator mechanism including motor and drive train a strong spring.

The problem with reversing the polarity is that many modern vehicle controllers do not allow reverse polarity and more noise is generated due to longer motor operating duration.

The problem with an actuator incorporating a clutch mechanism is that the clutch mechanism itself is expensive, complex and has several parts and that such clutches do not operate consistently.

The problem with back driving the motor and power train is that the motor must be more powerful (and thus more expensive and heavier) to overcome the strong spring, more noise is generated due to longer operating duration, and some systems using helical gears cannot be back driven due to the large lead angle of the helical gears.

Known latch assemblies have primary latched positions wherein the associated door is fully closed and secondary latched positions wherein the associated door is not fully shut but nevertheless is prevented from opening. Such an arrangement has been used particularly on passenger doors of cars as a safety feature and in a legal requirement in many countries. Typically the door seals situated around the periphery of the door, which provide a weather tight seal between the door and its associated aperture, are resilient and are compressed when the door is in its closed condition. Releasing of the latch then allows the seals to partially open the door, at least past the secondary latched position, allowing the user to then fully open the door.

However a problem with such an arrangement is that under some conditions the seal force which tends to open the door can be insufficient to push the latch bolt past the secondary latched position resulting in a door that only opens to the secondary latched position. Under such circumstances the latch has to be unlatched again from the secondary latched position either manually by pulling on a door handle again or in the case of an actuator driven latch by operating the actuator for a second time and pulling the door open. Insufficient seal load could be caused by a door frozen into a closed position, poor fit/misalignment of the door, heavy vertically opening rear trunk lids.

It is an object of the present invention to provide a latch assembly including a power actuator which does not require to be driven in a reverse direction.

It is another object of the present invention to provide a latch assembly including a power actuator which does not require clutch mechanisms between a motor and a drive train of the power actuator.

SUMMARY OF THE INVENTION

It is another object of the present invention to provide a latch assembly including a power actuator which does not require back driving of the drive train and motor.

It is another object of the present invention to provide a latch assembly having a latch mechanism that does not engage a secondary latch position when operated.

Thus according to the present invention there is provided a latching mechanism including a latch bolt moveable between a primary latched position and an open position, a first pawl moveable between a first engaged position where it secures the latch bolt in at least its primary latched position and a second released position where it releases the latch bolt from at least its first primary latched position, release means moveable between a first engaged position where it allows the first pawl to achieve its first engaged position and a second released position where it retains the first pawl in its second released position, and a second pawl moveable between a first engaged position where it is capable of retaining the release means in its second released position and a second released position where it releases the release means from its second released position such that the latch mechanism can be latched and unlatched.

According to a further aspect of the present invention there is provided latch mechanism including a power actuator, the power actuator having a motor and a drive train, the drive train having at least one abutment for engagement with a release means of the latch mechanism, energization of the motor causing the abutment to move the release means from a first engaged position to a second released position to release the latch, in which a retention means (58) is capable of retaining the release means in its second released position.

According to a further aspect of the present invention there is provided a latch mechanism including a power actuator, the power actuator having a motor and a drive train, the drive train having the plurality of abutments for engagement with a release arrangement of the latch mechanism, energization of the motor causing one of the plurality of abutments to move the release arrangement from a first engaged position to second released position to release the latch, resulting in another of the plurality of abutments co-operating with the release arrangement to provide a drive train stop.

BRIEF DESCRIPTION OF THE DRAWINGS

The invention will now be described, by way of example only, with reference to the drawings in which:

FIG. 4 is a view of the latch assembly of FIG. 1 shown in a latching condition whereby super-imposed views of the rotating claw are shown in a primary latched position and secondary latched position; and FIGS. 5 and 6 are views of a second embodiment of a latch assembly according to the present invention in an open and closed condition.

DESCRIPTION OF PREFERRED EMBODIMENT

Figure 1:
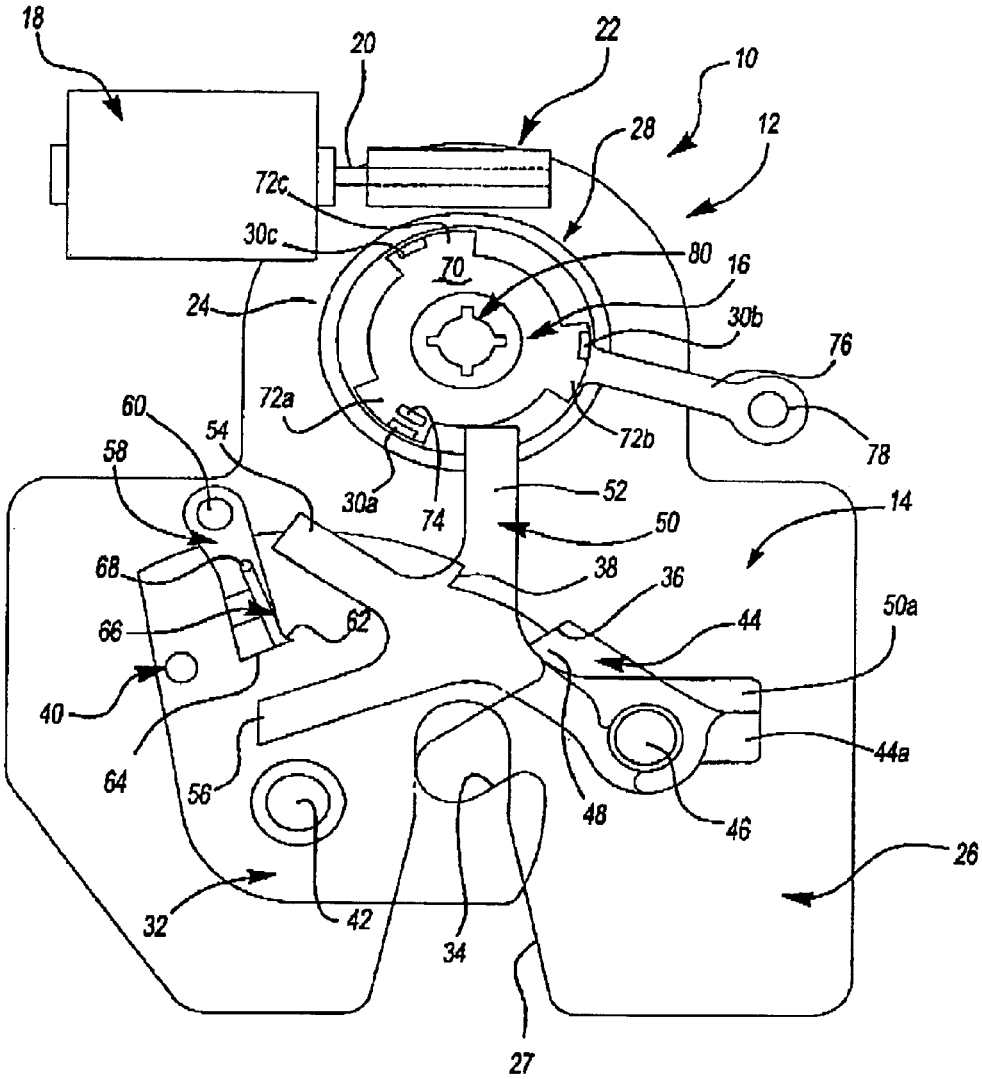
FIG. 1 is a view of a latch assembly according to the present invention in a closed condition.

With reference to FIGS. 1 to 4 there is shown a latch assembly 10 including a power actuator 12, a latch mechanism 14 and a manual release means 16.

In use the latch assembly 10 would be mounted on a door.

The power actuator includes a motor 18 having a motor shaft 20 drivingly connected to a pinion 22. The power actuator further includes a drive train in the form of a rotor 24.

Rotor 24 is journaled for rotation on plate 26 which forms part of the chassis of the latch assembly. Rotor 24 includes a set of gear teeth 28 which together with pinion 22 form a worm/worm gear drive arrangement. The rotor further includes three circumferentially equispaced posts 30A, 30B, 30C, which project out of the plane of the paper of FIG. 1.

The latched mechanism includes a latch bolt in the form of a rotating claw 32 having a mouth 34, a primary latching abutment 36, a secondary latching abutment 38 and a trip abutment in the form of a pin 40. The claw 32 is pivotally mounted about pivot 42 on plate 26.

Plate 26 includes a mouth 27 which in conjunction with the mouth 34 provides for the retention and release of a striker pin (not shown) mounted on an associated door aperture.

The rotating claw 32 is biased in a clockwise direction as shown in FIG. 1 by a resilient means (not shown), though in further embodiments this need not be the case.

The latch mechanism further includes a first pawl 44 pivotally mounted for rotation about pivot 46. Pawl 44 includes a pawl tooth 48 for engagement with the primary and secondary latching abutments 36 and 38 of the rotating claw. Also mounted rotationally about pivot 46 is a release lever 50 having first, second and third arms 52,54,56 respectively. Release lever 50 is biased in an anticlockwise direction by a resilient means (not shown) operably acting between the release lever 50 and the plate 26.

A further resilient means (not shown) operates between the first pawl 44 and release lever 50 to bias the first pawl 44 in an anticlockwise direction relative to the release lever 50. Abutment 44A on the first pawl and abutment 50A release on the lever cooperates to limit the anticlockwise movement of the first pawl relative to the release lever.

The latch mechanism further includes a second pawl 58 rotatably mounted about pivot 60 which is turn is mounted on plate 26. Second pawl 58 includes a hook 62 remote from pivot 60 and also a cam surface 64. Second pawl 58 is biased in an anticlockwise direction by a resilient means (not shown) operating between the second pawl 58 and the plate 26. An abutment (not shown) prevents the second pawl 58 from rotating further anticlockwise than is shown in FIG. 1.

Mounted on second pawl 58 is a third pawl 66 pivotally mounted about pivot 68. Third pawl 66 is arranged such that it can pivot anticlockwise about pivot 68 as a result of contact with pin 40 when the rotating claw 32 moves from a position shown in FIG. 1 to a position shown in FIG. 3 i.e. in an opening direction but cannot rotate about pivot 68 clockwise from the position shown in FIGS. 1 and 4 when the rotating claw 32 (and hence the pin 40) moves from the position as shown in FIG. 4 to the position as shown in FIG. 1 i.e. in a closing, there being an abutment (not shown) to prevent any such clockwise rotation.

In further embodiments the third pawl could be mounted on the chassis of the latch assembly and nevertheless co-operate with the second claw 58 and pin 40 to release the latch mechanism as described below.

The manual release means 16 comprises a boss 70 having three equispaced lobes 72A, 72B and 72C which bear on an inner surface of the rotor 24 to allow rotation of the boss 70 relative to the plate 26. Lobe 72A includes a post 74 projecting out of the plane of the paper of FIG. 1 substantially parallel to post 30A.

Lobe 72B further includes an arm 76 having a hole 78 at an end remote from the boss for connection with a manually operated release cable (not shown).

The boss 70 further includes a centrally splined portion 80 for engagement with a manually operable key barrel (not shown).

Operation of the latch assembly is as follows

With reference to FIG. 1 the latch assembly is shown in a closed position whereby the rotating claw is held in its latched position by the first pawl 44 which is in its corresponding first engaged position whereby tooth 48 engages the primary latching abutment 36. The release lever 50 is shown in its first engaged position and the second pawl 58 is shown in its first engaged position and the second pawl 58 is shown substantially in its first engaged position though as shown in FIG. 1 second pawl 58 is not engaging third arm 56 (see below).

Figure 2:
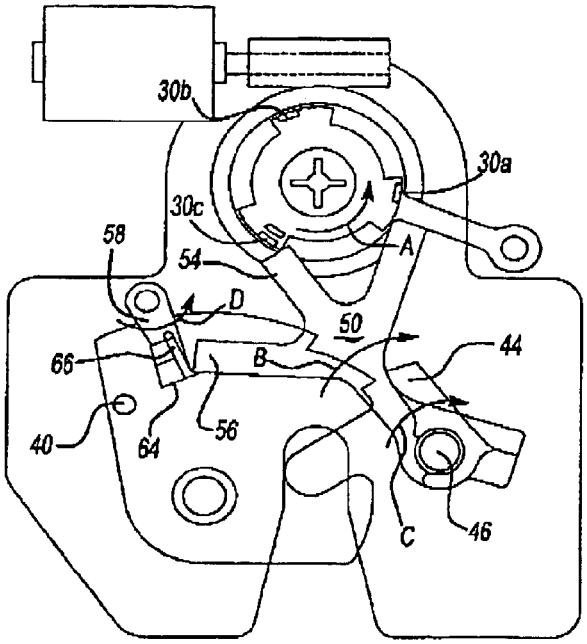
FIG. 2 is a view of the latch assembly of FIG. 1 shown in an unlatching condition.

The motor is energized for say 800 milliseconds, causing the rotor 24 to rotate anticlockwise in the direction of arrow A of the FIG. 2 resulting in post 30A engaging and moving first arm 52 to the position shown in FIG. 2. Clearly this movement of first arm 52 causing the release lever 50 and the first pawl 44 to both rotate about pivot 46 in a clockwise direction as shown by arrows B and C, thus disengaging pawl 48 from primary latching abutment 36.

During movement of release lever 50 from its first engaged position as shown in FIG. 1 to its second released position as shown in FIG. 2, the third arm 56 initially engages cam surface 64 causing second pawl 58 to rotate clockwise about pivot 60. Once the third arm 56 has passed the cam surface 64, the bias means (not shown) biases the second pawl 58 anticlockwise about pivot 60 such that the third arm 56 is engaged behind the hook 62, thus retaining the release lever 50 in the position as shown in FIG. 2. In this position the end of second arm 54 acts as a stop abutment in co-operation with post 30C preventing further rotation of rotor 24.

Typically the time taken to move from the position as shown in FIG. 1 to the position as shown FIG. 2 might be 500 milliseconds, thus the motor would be stalled for the last 300 milliseconds of the 800 millisecond motor energization as a result of post 30C abutting the end of second arm 54.

Figure 3:
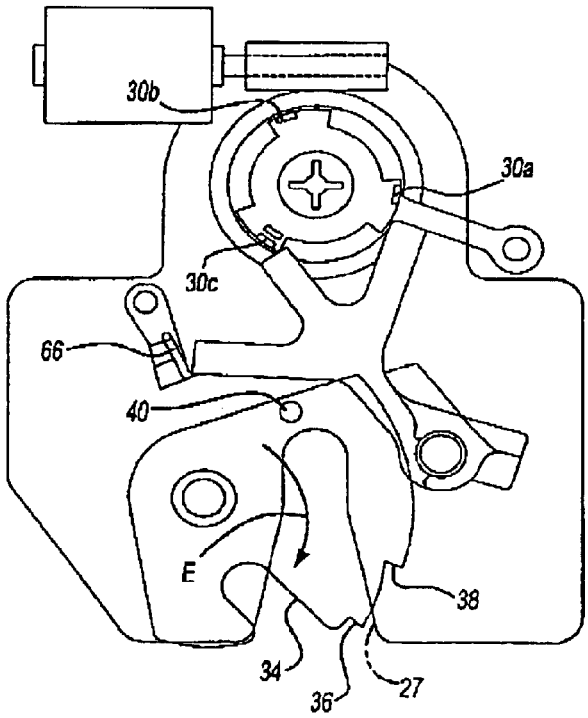
FIG. 3 is a view of the latch assembly of FIG. 1 shown in a latch opening condition.

Once the latch assembly has achieved the position as shown in FIG. 2 the latch claw is free to rotate in a clockwise direction as shown by arrow E of FIG. 3 thus releasing the striker from the mouth 27 and allowing the door, or trunk lid, etc. to open.

Note that in FIG. 2 the latch bolt is shown in its primary latched position though is free to rotate to its open position, the first pawl is shown in its second released position, the release lever is shown in its second released position, and the second pawl is shown in its first engaged position whereby it engages third arm 56.

Further note that first pawl 44 is maintained in its second release position by co-operating abutments 44A and 50A, and the release lever is maintained in its second release position by the second pawl. Thus it is the second pawl that maintains the first pawl in its second release position via the intermediary of the release lever 50.

As described above during the movement of the rotating claw from the position as shown in FIG. 2 to the position as shown in FIG. 3, the pin 40 trips past the third pawl 66 without affecting the position of the second pawl 58 which continues to retain third arm 56 and hence the release lever 50 in its second released position.

It should be noted that during movement of the rotating claw from the position as shown in FIG. 2 to the position as shown in FIG. 3, the pawl tooth 48 of the first pawl 44 is held out of engagement with the rotating claw and thus cannot engage the secondary latching abutment 38 as it passes underneath the pawl tooth 48.

Subsequent closing of the door associated with the latch assembly 10 causes the striker pin (not shown) to enter mouth 27 and mouth 34 resulting in the rotating claw 32 rotating anticlockwise in a closing direction as shown by arrow F of FIG. 4 to a secondary latched position as shown by profile X of rotating claw 32 or, the door is slammed hard enough, to a primary latched position as shown by profile Y of the rotating claw 32. This causes pin 40 to contact the third pawl 66 which, as described above, cannot rotate from the position shown in FIG. 4 clockwise relative to the second pawl 58. Thus the pin 40 causes the third pawl 66 and second pawl 58 to both rotate in unison clockwise as shown by arrow G about pivot 60. This action disengages the hook 66 from the end of third arm 56 allowing the release lever 50 and first pawl 44 to rotate anticlockwise as shown by arrows H and J thus re-engaging pawl tooth 48 with the primary or secondary latching abutment 36 or 38 as appropriate.

It should be noted that the relative positions of the pin 40, secondary latching abutment 38 and first pawl 44 is such that the hook 66 is caused to disengage the end of third arm 56 just before the secondary latching abutment 38 passes under pawl tooth 48. Thus in the event that the door is not slammed hard enough to be fully closed the pawl tooth 48 will nevertheless engage the secondary latching abutment 36 as described above.

Note that pin 40 moves past second pawl 58 when the rotating claw 32 moves from the closed position as shown in FIG. 1 to the open position as in FIG. 3 without affecting the position of the second pawl. Furthermore pin 40 again moves past second pawl 58 when moving from the open position as shown in FIG. 3 to the closed position as shown in FIG. 1, however, under these circumstances it does affect the position of the second pawl as it moves past the second pawl.

Subsequent energizing of the motor 18 following closing of the latch as shown in FIG. 4 will unlatch the door in a similar sequence as described above, but note that post 30C (as opposed to post 30A as described above) is now positioned to act on first arm 52 to open the latch. In this case since there are three posts 30A, 30B and 30C, a single energizing operation of motor 18 results in rotor 24 only rotating through 120 degrees.

In further embodiments there may be more or less than three posts connected to the rotor.

Manual operation of the manual release means 16 by either operation of the cable connected to hole 78 or operation of the key barrel engaged with splined portion 80 results in post 74 rotating anticlockwise and engaging and moving first arm 52 in a manner similar to that as described above wherein post 30A engages and moves first arm 52. Note that during this manual disengagement the pawl tooth 48 cannot engage the secondary latching abutment 38 since it is held away from the rotating claw by the release lever 50 which is secured in its second released position by hook 62 as described above in relation to power opening of the latch.

Figure 6:
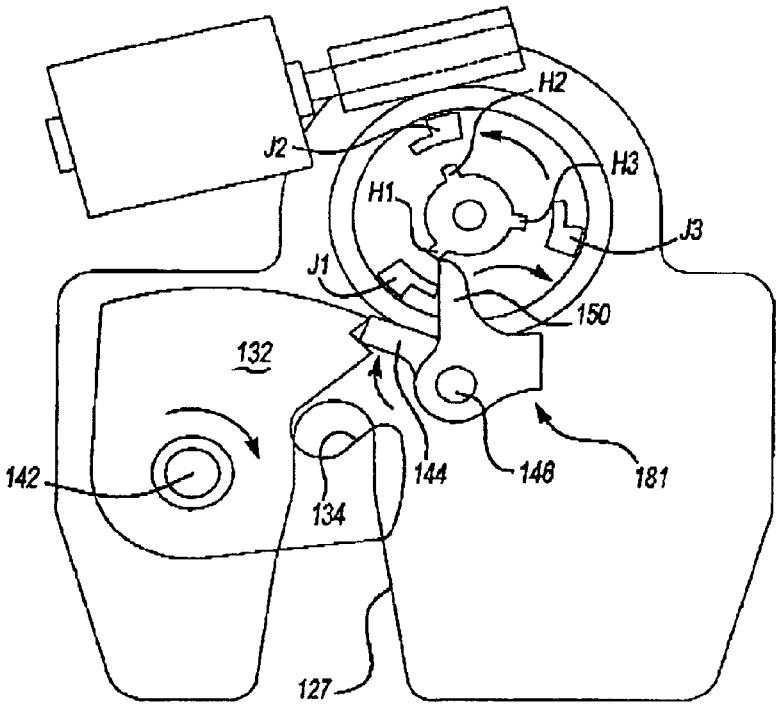

With reference to FIGS. 5 and 6 there is shown a second embodiment of a latch assembly 110 with features equivalent to latch assembly 10 labelled 100 greater.

A release arrangement 181 is formed by the combination of release lever 150 and pawl 144. In this case release lever 150 and pawl 144 are rotationally fast relative to each other, though in further embodiments this need not be the case.

Rotor 124 includes 3 abutments H1, H2 and H3 at a central portion of the rotor which form a first set of abutments H. Rotor 124 also includes abutments J1, J2 and J3 at a peripheral region of the rotor which form a second set of abutments J.

The release lever 150 and first set of abutments H lie in a first plane and the pawl 144 and second set of abutments J lie in a second plane different from the first plane thus allowing the second set of abutments J to past underneath release lever 150 when the rotor 124 rotates.

Operation of the latch assembly 110 is as follows:

Consideration of FIG. 6 shows the latch assembly 110 in a closed position with pawl 148 acting against latching abutment 136 to retain the rotating claw 132 in the closed position. It should be noted that abutment H1 is in contact with the end of release lever 150.

Actuation of motor 118 causes the rotor 124 to rotate in anticlockwise direction when viewing FIG. 6 whereupon abutment H1, acting on the end of release lever 150 causes the release lever and pawl 144 to rotate in a clockwise direction to the position as shown in FIG. 5.

It should be noted from FIG. 5 that abutment H1 has just disengaged the end of release lever 150 but at the same moment pawl tooth 148 has engaged abutment J2 thus stopping further rotation of the rotor and causing the motor 118 to momentarily stall until such time as the power to the motor is cut. Stopping the rotor 124 in this manner ensures that it is orientated in the correct position ready for its next operation.

One the power to the motor is cut then there is no longer any force acting between abutment J2 and pawl tooth 148 whereupon the pawl 144 and release lever 150 can return to the position as shown in FIG. 6 (though with the rotor 124 and rotating claw 132 remaining in the position as shown in FIG. 5) awaiting a subsequent closure of the latch.

It should be noted that the release lever is sequentially operated by abutments H1, H2 and H3 and that the rotor 124 sequentially stopped by abutment J1, J2 and J3. Furthermore the release lever is only ever operated by abutments H1, H2 and H3 and the rotor is only ever stopped by abutments J1, J2 and J3.

What is claimed is:

1. A latch mechanism comprising:

a latch bolt moveable between a primary latched position and an open position, a first pawl moveable between a first engaged position, where the first pawl secures the latch bolt in at least its primary latched position and a second released position, where the first pawl releases the latch bolt from at least its primary latched positions;

release means moveable between a first engaged position, where the release means allows the first pawl to achieve its first engaged position and a second released position, where the release means retains the first pawl in its second released position;

a second pawl moveable between a first engaged position, where the second pawl is capable of retaining the release means in its second released position, and a second released position, where the second pawl releases the release means from its second released position, such that the latch mechanism can be latched and unlatched;

a third pawl operatively coupled to the second pawl; wherein a trip abutment on the latch bolt engages the third pawl to move the second pawl from its first engaged position to its second released position to allow the latch mechanism to latch.

2. A latch mechanism as defined in claim 1 in which the release means is fast with the first pawl.

3. A latch mechanism as defined in claim 1 in which release means is moveable relative to the first pawl.

4. A latch mechanism as defined in claim 1 in which the latch bolt additionally has a secondary latched position intermediate the primary latch position and the open position.

5. A latch mechanism as defined in claim 1 in which the trip abutment is capable of moving the second pawl during movement of the latch bolt from its open position to its primary latched position.

6. A latch mechanism as defined in claim 1 in which the trip abutment does not affect retention of the release means in its second released position by the second pawl during movement of the latch bolt from its primary latched position to its open position.

7. A latch mechanism as defined in claim 1 in which the third pawl allows the latch bolt to move from its primary latched position to its open position without movement of the second pawl.

8. A latch mechanism as defined in claim 1 in which the third pawl is mounted on the second pawl.

9. A latch mechanism as defined in claim 1 in which the third pawl is mounted on a chassis of the latch assembly.

10. A latch mechanism as defined in claim 1 in which a first arm of the release means is engaged to move the release means from its first engaged position to its second released position.

11. A latch mechanism as defined in claim 1 in which an arm of the release means is engaged by the second pawl to retain the release means in its second released position.

12. A latch mechanism, comprising:

a power actuator having a motor and a drive train, wherein the motor operates in only one direction;

a latch bolt moveable between a primary latched position and an open position, a first pawl moveable between a first engaged position, where the first pawl secures the latch bolt in at least its primary latched position and a second released position, where the first pawl releases the latch bolt from at least its primary latched position, release means moveable between a first engaged position, where the release means allows the first pawl to achieve its first engaged position and a second released position, where the release means retains the first pawl in its second released position, a second pawl moveable between a first engaged position, where the second pawl is capable of retaining the release means in its second released position, and a second released position, where the second pawl releases the release means from its second released position such that the latch mechanism can be latched and unlatched.

13. A latch mechanism as defined in claim 12, in which the drive train includes a first abutment operable to move the release means from its first engaged position to its second released position.

14. A latch mechanism as defined in claim 13 in which the first abutment of the drive train engages the first arm of the release means.

15. A latch mechanism as defined in claim 12 in which the drive train includes a second abutment which cooperates with the release means to provide a drive train stop.

16. A latch mechanism as defined in claim 15 in which the second abutment co-operates with an arm of the release means.

17. A latch mechanism as defined in claim 15 in which the first abutment is capable of acting us the second abutment.

18. A latch mechanism including a power actuator, the power actuator having a motor and a drive train, the drive train having a plurality of abutments operatively coupled to each other for engagement with a release arrangement of the latch mechanism, energization of the motor causing one of the plurality of abutments to move the release arrangement from a first engaged position to second released position to release latch, causing another of the plurality of abutments cooperating with the release arrangement to provide a drive train stop.

19. A latch mechanism as defined in claim 18 in which the latch mechanism includes a latch bolt moveable between a primary latch position and an open position, and the release arrangement includes a first pawl moveable between a first engaged position where the first pawl secures the latch bolt in at least its primary latch position and a second release position, where the first pawl releases the latch bolt from at least its first primary latch position, the release arrangement further including release means moveable between the first engaged position, where the release means allows the first pawl to achieves its first engaged position and a second release position where the release means retains the first pawl in its second release position.

20. A latch mechanism as defined in claim 19 in which the release means is fast with the first pawl.

21. A latch arrangement as defined in claim 19 in which the release means is moveable relative to the first pawl.

22. A latch mechanism as defined in claim 18 in which the plurality of abutments includes a first set of abutments to move the release arrangement from the first engaged position to the second release position and a second set of abutments for co-operation with the release arrangement to provide the drive train stop.

23. A latch mechanism as defined in claim 22 in which the first set of abutments acts on the release means and the second set of abutments act on the pawl.

24. A latch mechanism, comprising:

a power actuator having a motor and a drive train, wherein the drive train operates in only one direction;

a latch bolt moveable between a primary latched position and an open position, a first pawl moveable between a first engaged position, where the first pawl secures the latch bolt in at least its primary latched position and a second released position, where the first pawl releases the latch bolt from at least its primary latched position, release means moveable between a first engaged position, where the release means allows the first pawl to achieve its first engaged position and a second released position, where the release means retains the first pawl in its second released position, a second pawl moveable between a first engaged position, where the second pawl is capable of retaining the release means in its second released position, and a second released position, where the second pawl releases the release means from its second released position such that the latch mechanism can be latched and unlatched.

25. A latch mechanism as defined in claim 24 in which the drive train includes a first abutment operable to move the release means from its first engaged position to its second released position.

26. A latch mechanism as defined in claim 25 in which the first abutment of the drive train engages the first arm of the release means.

27. A latch mechanism as defined in claim 24 in which the drive train includes a second abutment which co-operates with the release means to provide a drive train stop.

28. A latch mechanism as defined in claim 27 in which the second abutment co-operates with an arm of the release means.

29. A latch mechanism as defined in claim 27 in which the first abutment is capable of acting as the second abutment.

* * * * *

UNITED STATES PATENT AND TRADEMARK OFFICE

CERTIFICATE OF CORRECTION

PATENT NO. : 6,817,636 B1
DATED : November 16, 2004
INVENTOR(S) : Evans et al.

It is certified that error appears in the above-identified patent and that said Letters Patent is hereby corrected as shown below:

Title page,
Item [75], Inventors, please insert -- Mark Hao Li, Birmingham (GB) --

Column 6,
Line 62, "," should be -- ; --.
Line 67, "positions" should be -- position --.

Column 8,
Line 13, "cooperates" should be -- co-operates --.
Line 19, "us" should be -- as --.
Line 27, please insert -- a -- after "release" and before "latch".
Line 28, "cooperating" should be -- co-operating --.

Signed and Sealed this

Twenty-second Day of February, 2005

JON W. DUDAS
*Director of the United States Patent and Trademark Office*